US006161271A

United States Patent [19]

Schreiter

[11] Patent Number: 6,161,271

[45] Date of Patent: Dec. 19, 2000

[54] METHOD FOR MOUNTING A SLIDER MECHANISM TO RECLOSEABLE FLEXIBLE PACKAGING

[75] Inventor: Michael E. Schreiter, Calumet County, Wis.

[73] Assignee: Reynolds Consumer Products, Inc., Appleton, Wis.

[21] Appl. No.: 09/363,626

[22] Filed: Jul. 29, 1999

[51] Int. Cl.[7] ..... B29D 5/00; A41H 37/06

[52] U.S. Cl. ..... 29/408; 29/768; 29/453; 383/64

[58] Field of Search ..... 29/408, 409, 768, 29/453; 24/399, 400; 53/133.4; 383/64; 493/213, 927

[56] References Cited

U.S. PATENT DOCUMENTS

| | | | |
|---|---|---|---|
| 2,879,588 | 3/1959 | Morin | 29/768 |
| 3,115,689 | 12/1963 | Jacobs . | |
| 3,122,807 | 3/1964 | Ausnit . | |
| 3,230,593 | 1/1966 | Herz . | |
| 3,324,520 | 6/1967 | Ausnit . | |
| 3,426,396 | 2/1969 | Laguerre . | |
| 3,629,926 | 12/1971 | Maeda et al. | 29/768 |
| 3,660,875 | 5/1972 | Gutman . | |
| 3,701,191 | 10/1972 | Laguerre . | |
| 3,701,192 | 10/1972 | Laguerre . | |
| 3,713,923 | 1/1973 | Laguerre . | |
| 3,790,992 | 2/1974 | Herz . | |
| 3,806,998 | 4/1974 | Laguerre . | |
| 3,889,341 | 6/1975 | Takamatsu | 29/768 |
| 4,262,395 | 4/1981 | Kosky . | |
| 4,581,006 | 4/1986 | Hugues et al. . | |
| 5,067,208 | 11/1991 | Herrington, Jr. et al. . | |
| 5,088,971 | 2/1992 | Herrington . | |
| 5,113,567 | 5/1992 | Yunoki | 29/768 |
| 5,131,121 | 7/1992 | Herrington, Jr. et al. . | |
| 5,211,482 | 5/1993 | Tilman . | |
| 5,283,932 | 2/1994 | Richardson et al. . | |
| 5,431,760 | 7/1995 | Donovan . | |
| 5,769,772 | 6/1998 | Wiley . | |
| 5,788,378 | 8/1998 | Thomas . | |
| 5,833,791 | 10/1998 | Bryniarski et al. . | |

*Primary Examiner*—P. W. Echols
*Attorney, Agent, or Firm*—Alan M. Biddison

[57] ABSTRACT

A method for mounting a slider device on a recloseable package includes mounting the slider device by intersecting the slider device with a zipper arrangement so that at least one of the slider device and the zipper arrangement is distorted to allow mounting. A particular method includes mounting the slider device includes intersecting the slider device with the zipper arrangement at an angle between about 20 to 60°, preferably about 45°. In another method, the zipper arrangement is distorted to facilitate mounting of the slider device thereon, and in yet another method, the slider device is distorted to facilitate mounting.

10 Claims, 7 Drawing Sheets

METHOD FOR MOUNTING A SLIDER MECHANISM TO RECLOSEABLE FLEXIBLE PACKAGING

FIELD OF THE INVENTION

The present invention generally relates to closure arrangements for polymer packages, such as plastic bags. In particular, the present invention relates to recloseable closure mechanisms or zipper-type closures for packages.

BACKGROUND

Many packaging applications use resealable containers to store or enclose various types of articles and materials. These packages may be used to store food products, non-food consumer goods, medical supplies, waste materials, and many other articles. Resealable packages are convenient in that they can be closed and resealed after the initial opening to preserve the enclosed contents. The need to locate a storage container for the unused portion of the products in the package is thus avoided. In some instances, providing products in resealable packages appreciably enhances the marketability of those products.

Some types of resealable packages are opened and closed using a slider device. Sliding the slider device in a first direction opens the package to allow access to the interior of the package, and sliding the slider device in an opposite second direction seals the package. The slider device typically includes a separator or spreader-type structure at one end that opens and closes a profiled closure mechanism on the resealable package, depending on the direction of movement. The sidewalls of the slider device are configured so that the sidewalls engage the closure profiles and progressively move them into engagement to close the resealable package when the slider device is moved along the closure mechanism in a direction opposite the first direction.

With the growing popularity of these slider closure mechanisms, there is a desire to improve the processes used to attach the slider device to the resealable package with the profiled closure mechanism.

SUMMARY OF THE INVENTION

The present invention relates to methods of mounting a slider device onto flexible packages comprising a recloseable closure mechanism, such as a "zipper-type" closure mechanism.

In particular, one embodiment of the invention relates to a method of mounting a slider device on a recloseable closure arrangement for a recloseable package, comprising mounting the slider device onto the closure arrangement by moving the slider device at an angle relative to the closure arrangement, intersecting the first end of the slider device with the closure arrangement, snapping the first end of the slider device over the closure arrangement, and then snapping the second end of the slider device over the closure arrangement.

In another embodiment, the invention relates to a method of mounting a slider device by distorting the slider device, the closure arrangement, or both.

In this embodiment, the distal end of the closure arrangement can be distorted to facilitate mounting the slider closure device thereon. In particular, the method comprises mounting the slider device onto the closure arrangement by moving the slider device partially over the closure arrangement so that a first closure construction distal end and a second closure construction distal end are positioned in a gap between first and second leg constructions of the slider device, decreasing the distance between the first and second closure constructions, and moving the slider device farther over the closure arrangement until the slider device is mounted on the closure arrangement.

Alternately, the leg constructions of the slider device, which lock over the closure arrangement, can be distorted to facilitate mounting the slider device. In particular, the method comprises mounting the slider device onto the closure arrangement by distorting at least one of the first leg construction and the second leg construction to increase the distance therebetween, moving the slider device over the closure arrangement until the slider device is mounted on the closure arrangement, and then decreasing the distance between the first leg construction and the second leg construction.

The above summary of principles of the present invention is not intended to describe each illustrated embodiment or every implementation of the present invention. The figures and the detailed description that follow more particularly exemplify certain preferred embodiments utilizing the principles disclosed herein.

BRIEF DESCRIPTION OF THE DRAWINGS

Principles of the invention may be more completely understood in consideration of the detailed description of various embodiments of the invention that follows in connection with the accompanying drawings in which.

DETAILED DESCRIPTION

The present invention is applicable to applying a slider device to a variety of packaging arrangements. An appreciation of various aspects of the invention is best gained through a discussion of a preferred example of such a packaging arrangement and the slider device.

A. The Package and Closure Construction

Figure 1:
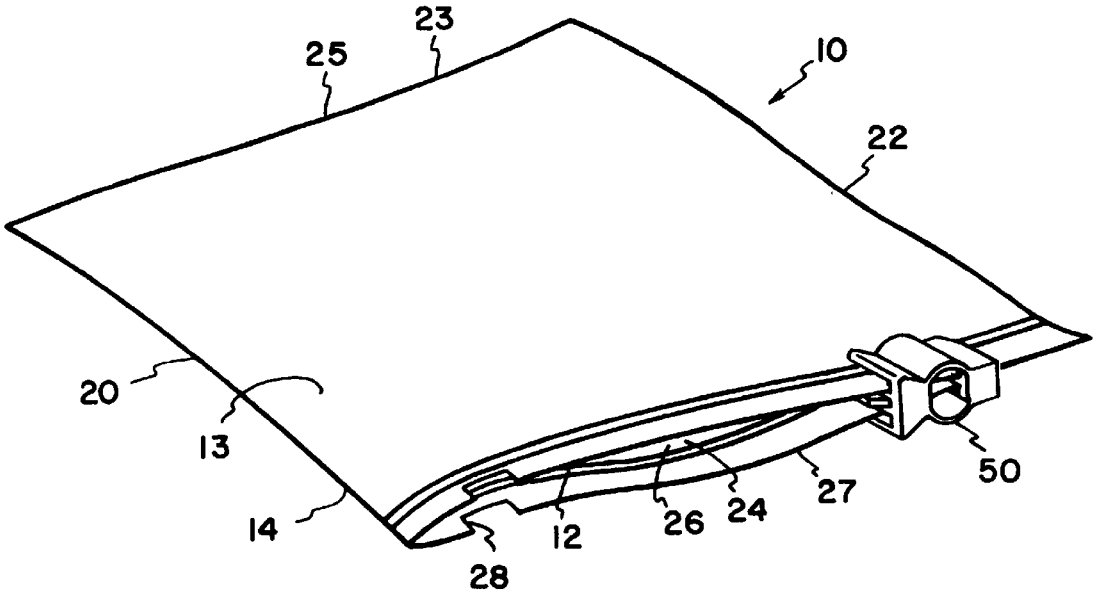
FIG. 1 is a perspective view of a flexible, recloseable package having a slider device.

Attention is directed to FIG. 1, which illustrates an example packaging arrangement in the form of a recloseable, flexible package 10, for example, a polymeric package such as a plastic bag, having a recloseable closure mechanism 12, for example, interlocking profiled elements, and a slider device for opening and closing the closure mechanism 12. In addition to being recloseable, package 10 may be resealable; that is, closure mechanism 12 not only closes package 10 but also seals package 10.

The flexible package 10 includes first and second opposed panel sections 13, 14, typically made from a flexible, polymeric, plastic film. With some manufacturing applications, the first and second panel sections 13, 14 are heat-sealed together along two side edges 20, 22 and meet at a fold line 23 in order to form a three-edged containment section for a product within an interior 24 of the package 10. In the embodiment shown, the fold line 23 comprises the bottom edge 25 of the package 10. Alternatively, two separate panel sections 13, 14 of plastic film may be used and heat-sealed together along the two side edges 20, 22 and at the bottom edge 25. Access is provided to the interior 24 of the package 10 through a mouth 26 at a top edge 27 of the package. In the particular embodiment shown, the mouth 26 extends the width of the package 10.

The closure mechanism 12 is illustrated in FIG. 1 at the mouth 26 of the flexible package 10. Alternatively, the closure mechanism 12 could be positioned on the package 10 at a location different from the mouth 26 of the package 10, depending on the application needs for the package 10. The closure mechanism 12 can be one of a variety of closure mechanisms. In the particular embodiment illustrated in FIG. 2, the recloseable closure mechanism 12 is shown in the specific form of a zipper-type closure mechanism. By the term "zipper-type closure mechanism," it is meant a structure having opposite interlocking or mating profiled elements that under the application of pressure will interlock and close the region between the profiles.

Figure 2:
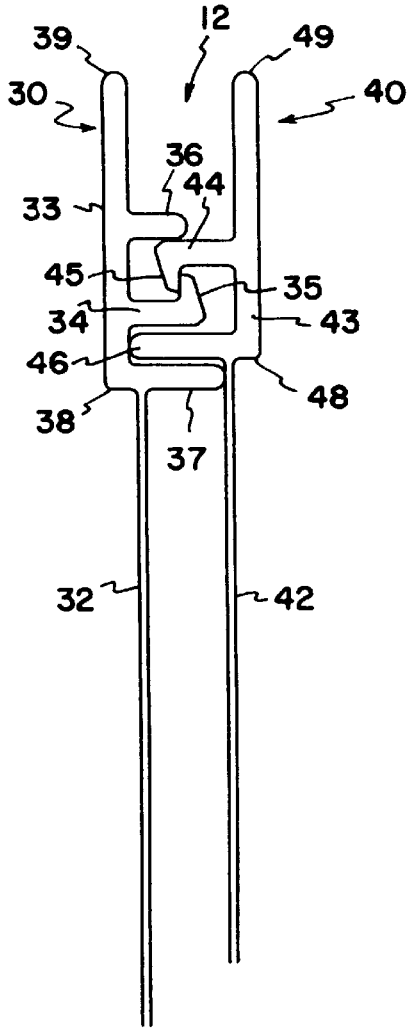
FIG. 2 is a cross-sectional view of profiled elements usable with the recloseable package of FIG. 1.

In particular, the zipper-type closure mechanism in FIG. 2 is an illustration of one example of a closure mechanism 12. The closure mechanism 12 includes an elongated first closure profile 30 and an elongated second closure profile 40. Typically, the closure profiles 30, 40 are manufactured separately from each other.

Still in reference to FIG. 2, the preferred first closure profile 30 depicted includes a sealing flange or bonding strip 32, a base strip 33, a first closure member 34, first and second guide posts 36, 37, and an upper flange 39. The closure member 34 extends from the base strip 33 and is generally projecting from the base strip 33. At a free end or tip of the closure member 34 is a hook or catch 35. The guide posts 36, 37 also extend from the base strip 33 and are generally projecting from the base strip 33. The guide posts 36, 37 aid in holding the closure mechanism 12 closed and in aligning the first closure profile 30 with the second closure profile 40 for interlocking. The bonding strip 32 depends or extends downward from the second guide post 37 and can be attached to a first panel section, such as the first panel section 13 of the package 10 of FIG. 1. A first shoulder 38 is defined by the intersection of the base strip 33 and bonding strip 32. In the example illustrated, the bonding strip 32 is spaced a distance laterally from the base strip 33 to define a comer forming the shoulder 38. The upper flange 39 extends upwardly from the base strip 33 and first guide post 36.

The preferred second closure profile 40 depicted includes a bonding strip 42, a base strip 43, a closure member 44, a guide post 46, and an upper flange 49. The closure member 44 extends from the base strip 43 and is generally projecting from the base strip 43. At a free end or tip of the closure member 44 is a hook or catch 45. The guide post 46 also extends from the base strip 43 and is generally projecting from the base strip 43. The guide post 46 aids in holding the closure mechanism 12 closed and aids in aligning the second closure profile 40 with the first closure profile 30 for interlocking. The bonding strip 42 depends or extends downward from the guide post 46 and can be attached to a second panel section, such as the second panel section 14 of the package 10 of FIG. 1. A shoulder 48, analogous to the shoulder 38, is formed at the comer of the bonding strip 42 and guide post 46.

The first and second closure profiles 30, 40 are designed to engage with one another to form the recloseable closure mechanism 12. The closure member 34 of the first closure profile 30 extends from the base strip 33 an engagement distance. The closure member 44 of the second closure profile 40 also extends from the base strip 43 an engagement distance. These engagement distances that the closure members 34, 44 extend are sufficient to allow mechanical engagement, or interlocking, between the first closure member 34 of the first closure profile 30 and the closure member 44 of the second closure profile 40. In particular, the catches 35, 45 hook or engage each other. Furthermore, the closure profiles 30, 40 are sealed together at their ends, such as at side edges 20, 22 in FIG. 1, to further aid in aligning the closure profiles 30, 40 for interlocking through processes such as ultrasonic crushing or welding. Pressure is applied to the closure profiles 30, 40 as they engage to form the openable sealed closure mechanism 12. Pulling the first closure profile 30 and the second closure profile 40 away from each other causes the two closure profiles 30, 40 to disengage, opening the package 10 of FIG. 1. This provides access to the interior 24 of the package 10 through the mouth 26.

In some applications, the closure profiles 30, 40 are formed by two separate extrusions or through two separate openings of a common extrusion. Typically, the closure mechanism 12 is made of a polymer, plastic material, such as polyethylene or polypropylene. In one example embodiment, the closure arrangement illustrated in FIG. 2 is manufactured using conventional extrusion and heat sealing techniques.

Figure 5:
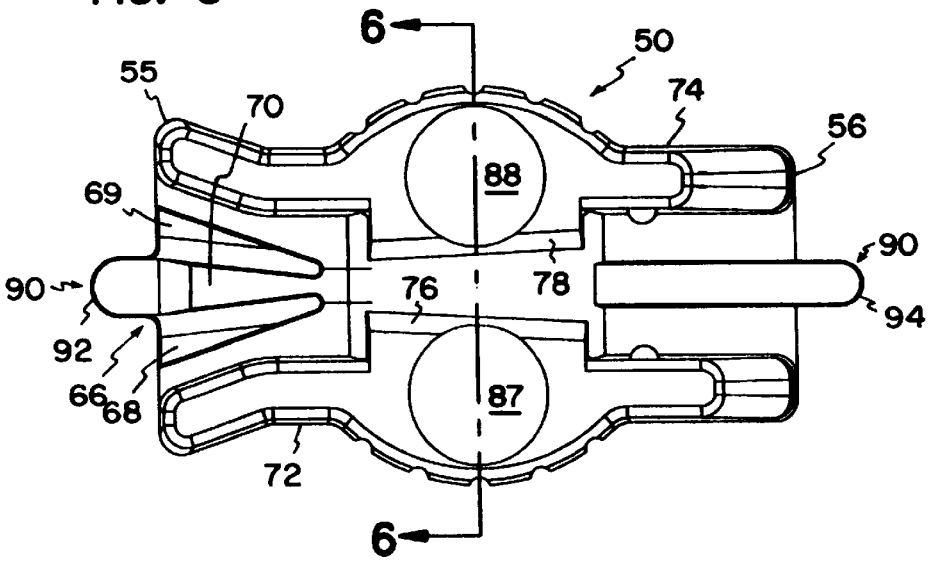
FIG. 5 is a bottom plan view of the slider device depicted in FIGS. 3 and 4.

Attention is again directed to FIG. 1. In FIG. 1, note that there is a cutout or notch 28 formed in the upper flanges 39, 49 (FIG. 2) of the closure mechanism 12. The preferred notch 28 shown includes three straight edges or sides and is formed twice as long as the length of the spreader 66 of slider 50 (FIG. 5). As to be explained in further detail below, the notch 28 serves as a "parking place" for a slider device 50 and may also facilitate mounting the slider device 50 onto the recloseable package 10 during initial assembly. In addition, the edge closest to the side seal 20 helps to create a stop member for the slider device 50.

B. The Slider Device Construction

Figure 3:
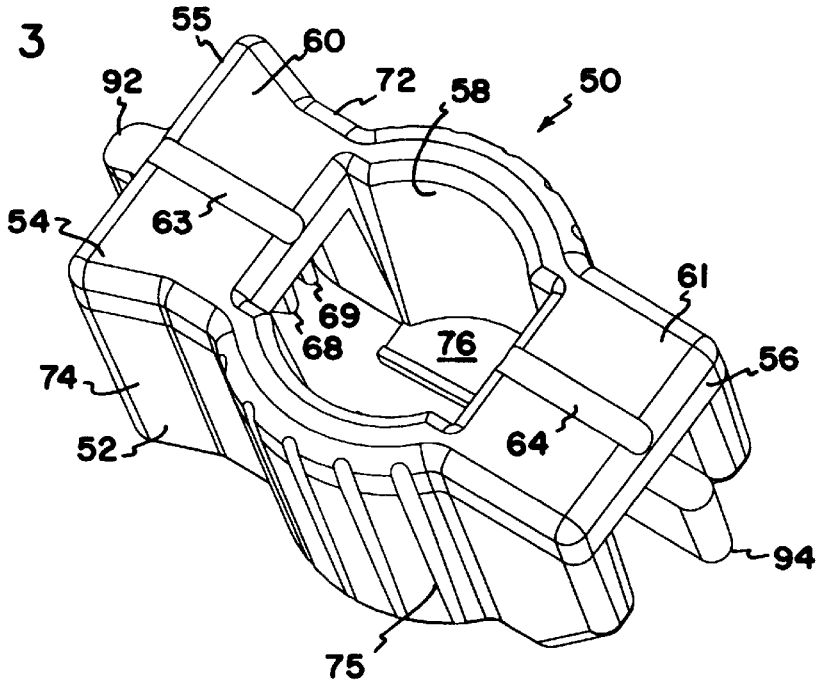
FIG. 3 is an enlarged, top perspective view of the slider device of FIG. 1.
Figure 4:
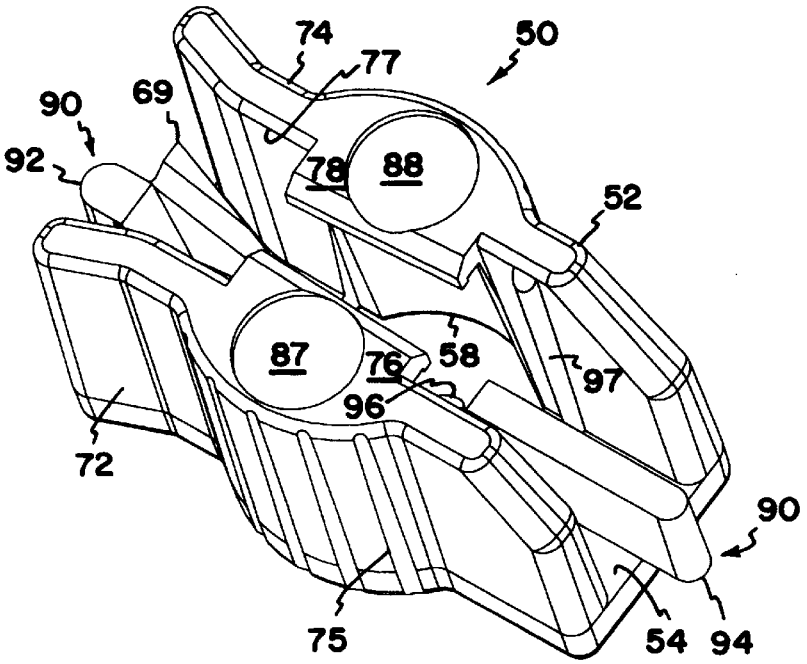
FIG. 4 is an enlarged, bottom perspective view of the slider device of FIGS. 1 and 3.

Still referring to FIG. 1, the slider device 50 is provided to open and close the closure mechanism 12. Attention is now directed to FIGS. 3 and 4. One preferred slider device 50 is illustrated in FIGS. 3 and 4 in perspective view and preferably comprises a one-piece unitary, molded plastic member with no moveable parts. In general, the slider device 50 includes a housing 52 for slidably engaging the closure mechanism 12. The housing 52 is movable between a closed position of the package 10 when the housing 52 is adjacent the side edge 20 and an open position of the package 10 when the housing 52 is adjacent the side edge 22. FIG. 1 illustrates the recloseable package 10 in an predominantly open position. The housing 52 slides over the resealable closure mechanism 12 relative to the top edge 27 of the resealable package 10 to open and close mouth 26.

The housing 52 is preferably a multi-sided container configured for engaging or locking onto or over the closure mechanism 12. In the particular embodiment illustrated in FIGS. 3 and 4, the housing 52 includes a top wall 54. By the term "top", it is meant that in the orientation of the slider device 50 shown in FIG. 3, the wall 54 is oriented above the remaining portions of the housing 52. It should be understood, of course, that if the housing 52 is moved from the orientation shown in FIG. 3, the top wall 54 will not be in a top orientation. The top wall 54 defines a first end 55 and an opposite second end 56. The top wall 54 also defines an open aperture 58. The open aperture 58 divides the top wall 54 between a first portion 60 and a second portion 61. The first portion 60 generally comprises a flat, planar portion in extension from a periphery of the open aperture 58 to the edge defined by the first end 55. Similarly, the second portion 61 generally comprises a flat, planar portion in extension from a periphery of the open aperture 58 to the edge defined by the second end 56. Each of the first and second portions 60, 61 defines a groove 63, 64 respectively. The aperture 58 and grooves 63, 64 aid in providing a structure that may be more easily injection molded.

The housing 52 includes a separation structure for separating the first and second closure profiles 30, 40. That is, when the closure mechanism 12 is in a closed state such that the closure members 34, 44 are interlocked, the separation structure will apply a force to wedge open and pull the closure members 34, 44 apart from each other. In the embodiment illustrated, the housing 52 includes a plow or spreader 66 operating as a separation structure. The spreader 66, in the preferred embodiment shown, extends or depends from the top wall 54. Preferably, the spreader 66 comprises first and second angled wedges 68, 69 separated by a gap 70 (FIG. 5) therebetween.

In FIG. 5, it can be seen that the first and second wedges 68, 69 are angled toward each other, from the first end 55 of the slider device 50 to an opposite end of the wedges 68, 69, to form an overall triangular shaped spreader 66. The gap 70 between the first wedge 68 and second wedge 69 helps to contribute to convenient manufacturing techniques for the housing 52, such as injection molding. Preferably, the spreader 66 only extends partially in the closure mechanism 12. More preferably, the spreader 66 only extends between the open flanges 39, 49 and does not penetrate the closure members 34, 44. This helps to ensure a leak-proof closure mechanism 12. In the preferred embodiment shown, the spreader 66 preferably extends about 0.125 inch from the first portion 60 of the top wall 54.

In reference again to FIGS. 3 and 4, the preferred housing 52 shown also includes first and second side walls 72, 74. Preferably, each of the first and second sidewalls 72, 74 extends from and is cantilevered from the top wall 54 to form a slide channel 77 therebetween. In preferred embodiments, the first and second sidewalls 72, 74 are injection molded with the remaining parts of the housing 52. In other words, preferably the housing 52 comprises a single, unitary, integral piece of material with no additional materials welded, fastened, or bolted together. As can be viewed in FIGS. 3 and 4, the sidewalls 72, 74 can include texturization, such as ribs 75, to help improve gripping and handling by the user. In FIG. 5, note that the sidewalls 72, 74 diverge away from each other at the first end 55 in the first portion 60; form convex portions in a middle section; and are generally parallel in the second portion 61. These features also facilitate gripping and handling by the user.

Preferably, the housing 52 includes a system for permitting the housing 52 to slide along the closure mechanism 12 without becoming disengaged from the recloseable package 10. In the embodiment illustrated, the system of the slider housing 52 engages or interlocks with certain structure of the closure mechanism 12. In particular, the housing 52 has a first and a second engaging leg construction 76, 78. The first leg construction 76 preferably extends from the first sidewall 72 in a portion of the housing 52 that is under the open aperture 58. As illustrated in FIGS. 3 through 7, the leg constructions are preferably hooking constructions 76, 78.

Figure 6:
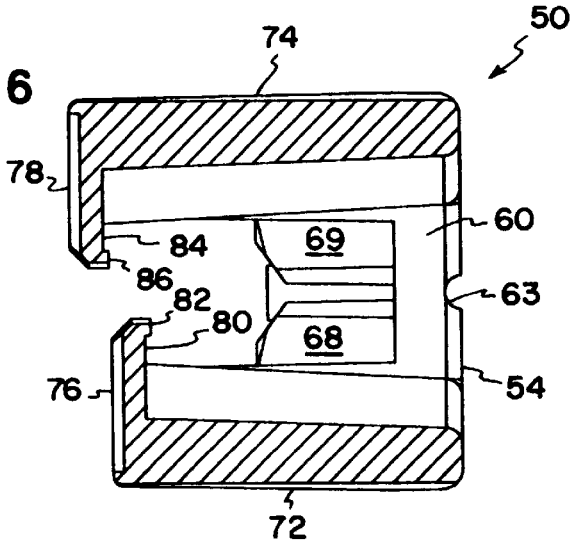
FIG. 6 is a cross-sectional view of the slider device depicted in FIG. 5 taken along the line 6—6 of FIG. 5.

In reference now to FIG. 6, first hooking construction 76 preferably includes a flange 80 in lateral extension from the first sidewall 72. Extending or projecting from flange 80 is a tip 82 oriented toward the top wall 54. As such, the tip 82, in combination with the flange 80, forms a hook or catch for slidable engagement with the shoulder 48 of the second closure profile 40.

Analogously, second hooking construction 78 preferably extends from the second sidewall 74 and includes a flange 84 in extension from the second sidewall 74 and in a region of the housing 52 below the open aperture 58. A tip 86 projects or extends from flange 84 in a direction oriented toward the top wall 54. As such, the flange 84 and tip 86 cooperate to form a hook or catch for engaging in a slidable manner with the shoulder 38 of the first closure profile 30. As can be seen in FIG. 6, the first hooking construction 76 is located closer to the top wall 54 than the second hooking construction 78. This is generally because, in the embodiment shown, the second sidewall 74 is longer than the first sidewall 72.

Attention is again directed to FIGS. 4 and 5. Each of the first and second hooking constructions 76, 78 has circular, partial cavities 87, 88, respectively, formed therein. These cavities 87, 88 help facilitate convenient manufacturing techniques, such as injection molding.

The slider device 50 preferably includes a system for guiding the slider device 50 between the side edges 20, 22 (FIG. 1) and for preventing the slider device 50 from sliding off the edge of the package 10 (FIG. 1). In the embodiment illustrated, the system includes a guide construction 90 (FIG. 4). Preferably, the guide construction 90 is designed to project beyond the first and second ends 55, 56 of the top wall 54. This ensures that the guide construction 90 detects the side edges 20, 22 before any other structure on the housing 52 engages the sides 20, 22 of the package 10. Preferably, the guide construction 90 depends from the top wall 54, but could depend from other portions of the housing 52 in other embodiments.

While a variety of structures are contemplated, in the particular embodiment illustrated in the drawings, the guide construction 90 comprises first and second bumpers or elongate fingers 92, 94. The first bumper or finger 92 preferably is molded as part of the housing 52 to extend a distance of at least about 0.06 inch (1.5 mm) beyond the first end 55 of the first portion 60. The second bumper or finger 94 likewise is preferably molded as part of the housing 52 to extend a distance of at least 0.06 inch (1.5 mm) beyond the second end 56 of the second portion 61.

In operation, the first finger 92 will abut or engage the side edge 20 to help contribute to preventing the housing 52 from sliding off of the recloseable package 10. Analogously, the second finger 94 will abut or engage the side edge 22 to prevent the housing 52 from sliding off of the recloseable package 10. Thus, the guide construction 90 keeps the housing 52 within the boundaries or periphery defined by the side edges 20 and 22.

Attention is again directed to FIGS. 4 and 5. In the preferred embodiment, the housing 52 includes a system for reducing drag. That is, the housing 52 is designed such that the surface area contact between the housing 52 and the closure mechanism 12 is minimal. In the embodiment illustrated, the system includes first and second drag reducing standoffs 96, 97. The first standoff 96 preferably projects or extends from the first sidewall 72 as a protrusion or pin or rod. Likewise, the second standoff 97 projects or extends from the second sidewall 74. In the preferred embodiment illustrated, the first and second standoffs 96, 97 project at least about 0.0085 inch (0.22 mm) from their respective sidewalls 72, 74. Preferably, the first standoff 96 extends the entire length between the bottom of the first sidewall 72 and the top wall 54. Likewise, preferably the second standoff 97 extends the entire length between the top wall 54 and the bottom edge of the second sidewall 74.

In operation, the standoffs 96, 97 slidably communicate with the first and second closure profiles 30, 40, respectively. Because of the projection and extension of the standoffs 96, 97 relative to the remaining portions of the housing 52, the amount of surface area contact or material inducing friction between the housing 52 and the recloseable closure mechanism 12 is minimized. This permits easier manipulation of the slider device 50 by the user.

To operate, the slider device 50 may be slid relative to the recloseable closure mechanism 12 in a first direction or an opposite second direction. As the housing 52 is moved from the closed position to the open position, the spreader 66 forces the closure members 34, 44 apart from each other. The spreader 66 is spaced between the upper flanges 39, 49 of the profile members 30, 40 and opens the mouth 26 of the package 10 as the slider housing 52 is moved along the recloseable package 10 in the direction toward where the triangle of spreader 66 "points." The opening happens because the triangular shape of the spreader 66 operates as a cam to force the profile members 30, 40 apart, and thus to disengage the interlocking members 34, 44. To close the closure mechanism 12, the slider housing 12 is moved relative to the closure mechanism 12 in the opposite direction. The closing happens because the slide channel 77 between the sidewalls 72, 74 is narrower at end 56 (the end away from the spreader 66) and is wider at the end 55 (the end near the spreader 66). The spreader 66 does not depend very far downwardly into the closure mechanism 12, and it never actually passes between the interlocking members 34, 44. Thus, this helps to prevent leaks in the closure mechanism 12, when the slider device 50 is in the closed position. The slider device housing 52 may be moved until the first finger 92 abuts edge of the notch 28. To open the package 10, the slider housing 52 is moved in the opposite direction to the open position. Note that no extra tools are needed for operation.

Additional information on slider devices is disclosed in U.S. provisional patent application having Ser. No. 60/108,845, filed Nov. 18, 1998 and incorporated herein by reference in its entirety.

To construct the flexible recloseable package 10 with a slider device 50, the package 10 may be formed by either a blown extrusion process or by using a pre-formed roll of film. The film is folded in the form shown in FIG. 1. The closure mechanism 12 may be applied to the film panel sections 13, 14 by heat sealing the bonding strips 32, 42 to the film sections. The notch 28 may be cut into the upper flanges 39, 49. Next, the side seals at edges 20, 22 may be formed, for example by ultrasonic crushing. The slider 50, in particular housing 52, is then mounted over the closure mechanism 12, for example, by sliding it onto the notch 28. The sequence of these steps may be rearranged as preferred, however it is preferred that the closure mechanism 12 with notch 28 is attached to panel sections 13, 14 prior to mounting slider 50.

As indicated previously, one preferred technique for manufacturing the slider housing 52 is injection molding. While other methods are possible, injection molding is convenient and preferred. In addition, injection molding allows for ornamental features, such as ribs 75, to be molded as part of the housing 52.

C. Methods and Apparatus for Mounting the Slider Device

Figure 7:
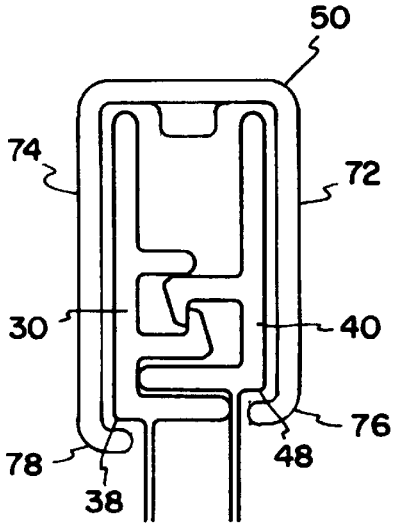
FIG. 7 is a schematic view of the profiled elements of FIG. 2 having the slider device of FIGS. 1 and 3 through 6 attached thereto.

Referring now to FIG. 7, slider 50 has been mounted onto the closure mechanism 12 so that the legs, e.g., first and second hooking constructions 76, 78, snap over and engage the shoulders 38, 48, of the closure profiles 30, 40, respectively. Processes for mounting the slider 50 onto closure mechanism 12 of package 10 are provided below.

Figure 8:
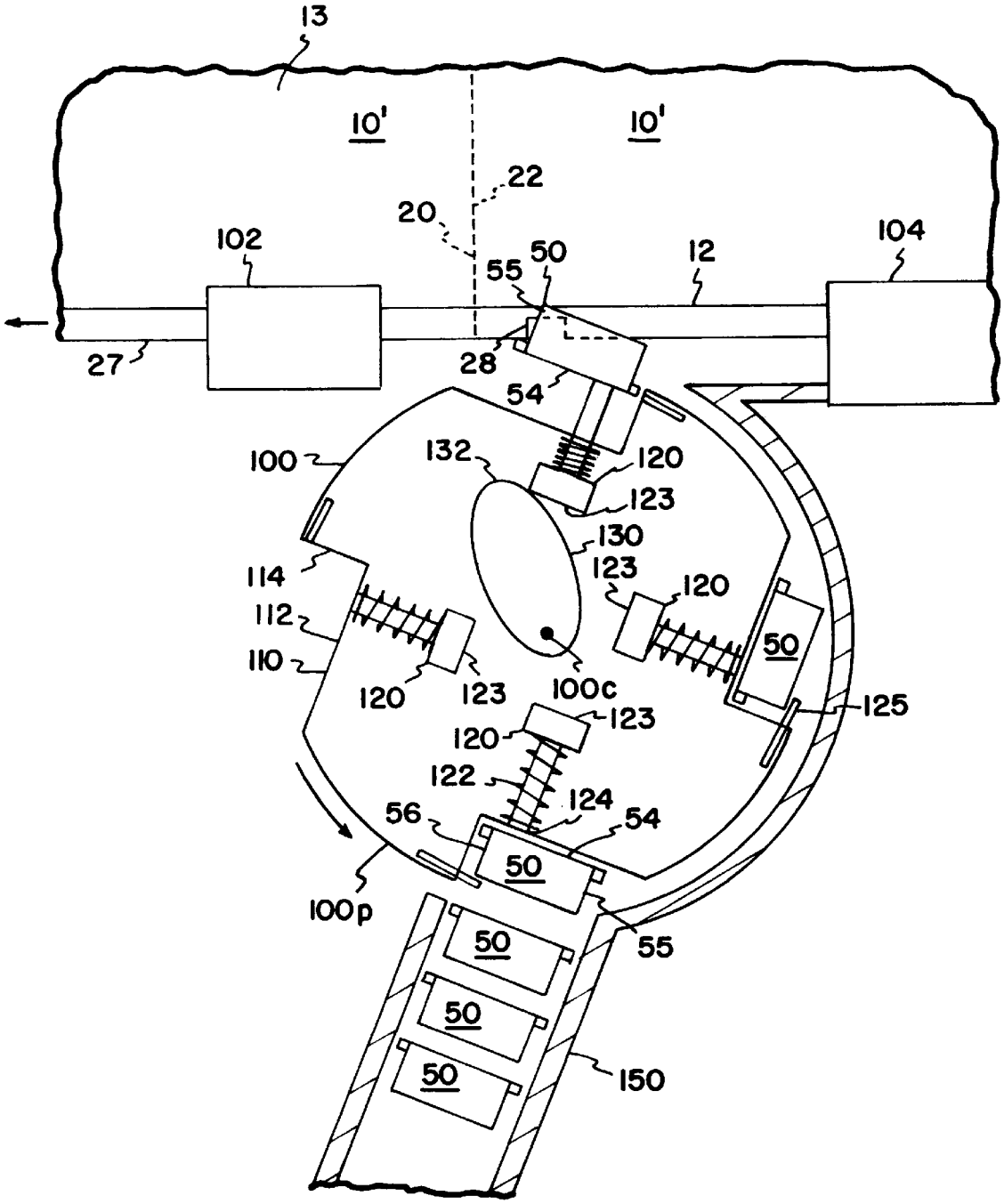
FIG. 8 is a schematic illustration of a first method of applying a slider device to a recloseable package, according to an example embodiment of the present invention.
Figure 9:
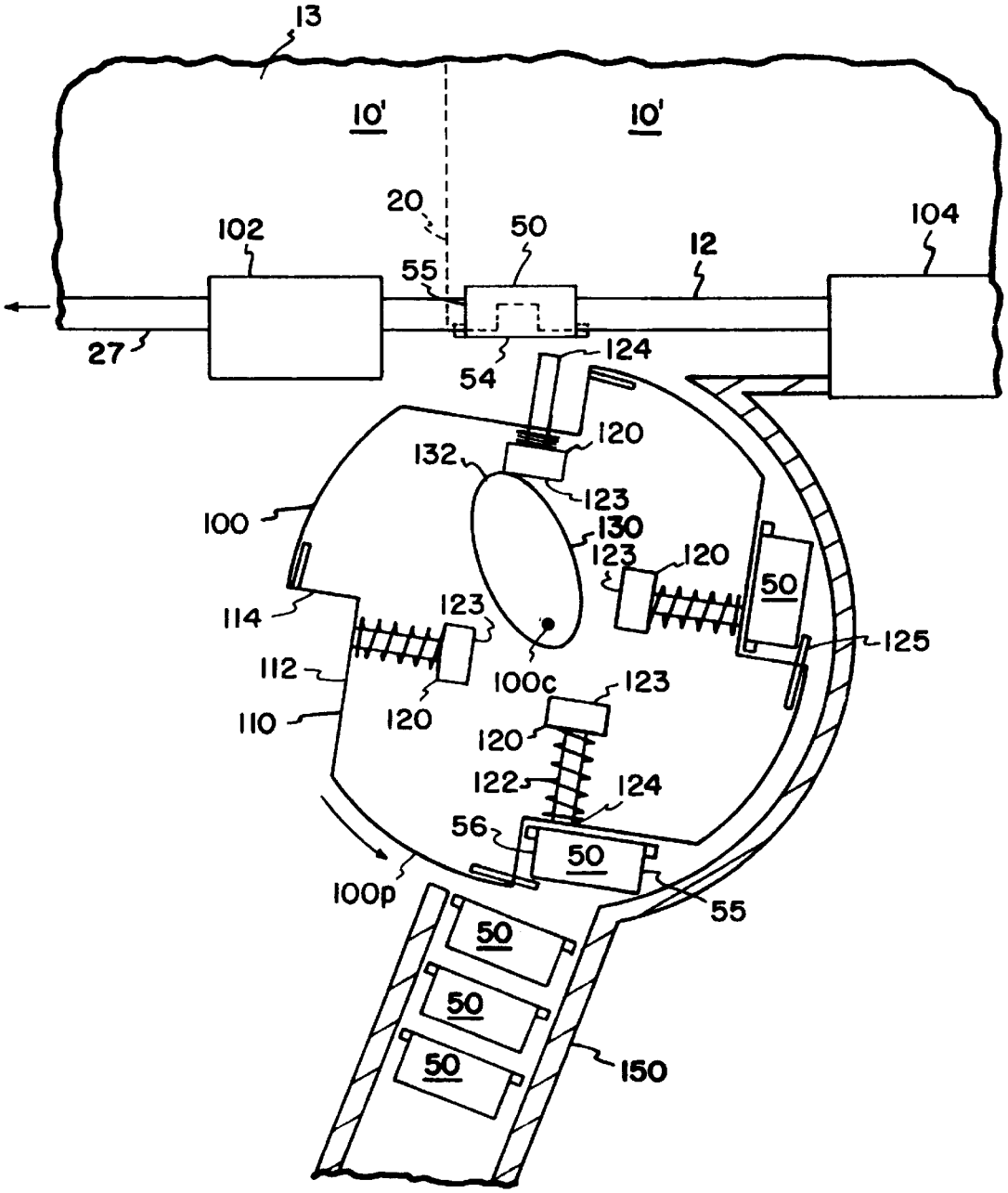
FIG. 9 is a schematic illustration of a further step in the first method of applying a slider device to a recloseable package, according to an example embodiment of the present invention.

A schematic top plan view of a first embodiment of a process for mounting the slider 50 on the closure mechanism 12 is shown in FIGS. 8 and 9. A rotating carousel 100 is used for positioning and attachment of slider 50 to closure mechanism 12. Guide devices 102, 104 are used to firmly hold packages 10' during the application process.

Inchoate packages 10', which have not been formed as individual bags, are shown in FIGS. 8 and 9 with top edge 27 including mouth 26 (not shown in FIG. 8; see FIG. 1) as the lowest most point of package 10'; bottom edge 25 (not shown in FIG. 8; see FIG. 1) would be at the top of the figure. Similar to packages 10, inchoate packages 10' comprise parallel panel sections 13, 14 (not shown in FIG. 8; see FIG. 1), typically polymeric film sheets, and closure mechanism 12 attached to panels 13, 14. Packages 10' are connected at side edges 20, 22; that is, the bags have an interior compartment formed by seams at points where the side edges 20, 22 would be, but bags have not been separated yet and remain as a continuous web. In some embodiments, the polymeric webs may not yet have any welds or seams that correspond to edges 20, 22. Further, in some embodiments, the method and apparatus of the present invention can be used to mount slider 50 on a completed package 10.

A plurality of sliders 50 is retained in stacked configuration by a guide chute 150. Sliders 50 should be stacked in such a manner that when slider 50 is deposited into carousel 100, top wall 54 contacts retention base 112 and second end 56 of slider housing 52 faces backwall 114, for reasons as will be described below.

From chute 150, slider 50 is deposited onto retention base 112 of retention area 110 of carousel 100. Carousel 100 is shown as having four equally spaced retention areas 110; however, more or less areas 110 may be present depending on carousel diameter, carousel rotation speed, and overall process speed. Retention area 110 is sized to retain slider 50 securely therein during rotation of carousel 100. A retaining pin 125 can be used to help retain slider 50 within retention area 110. Retaining pin 125 extends from, and is retractable into, backwall 114 of retaining area 110. Pin 125 may be perpendicular to backwall 114, may be parallel to retention base 112, or both.

The apparatus of the present invention preferably includes an ejection system for facilitating mounting slider 50 onto package 10'. The ejection system helps remove slider 50 from its position in retention area 110 and mount it onto closure mechanism 12. In a preferred embodiment, the ejection system comprises a extendible/retractable pin 120 in relation with retention base 112 of retention area 110. Retention area 110 and retention base 112 are configured so that the contact end 124 of pin 120 can extend through retention base 112 into retention area 110 to contact top wall 54 of slider 50. Pin 120 may include a spring 122 to facilitate the pin's retraction out from retention area 110. To extend pin 120 through retention base 112 into retention area 110, spring 122 is at least partially compressed, thereby allowing pin 120 to extend out into retention area 110. To retract pin 120 from retention area 110, spring 122 is allowed to expand. Pin 120 and spring 122 extension and retraction can be controlled by cam 130, which is positioned at the center of carousel 100.

In the embodiment illustrated in FIG. 8, cam 130 is a non-circular shaped piece used to impart motion to pin 120 as pin base 123 contacts cam 130. Cam 130 is stationary in respect to carousel 100. As carousel 100 with pins 120 rotates about an axis 100C shared with cam 130, the extended end 132 of cam 130 contacts pin base 123 and pushes pin 120 radially away from the center 100C of carousel 100 to its periphery 100P. The radial force on pin base 123 pushes pin 120, and contact end 124, outward to periphery 100P, thereby compressing spring 122 and allowing contact end 124 of pin 120 to extend into retention area 110. As carousel 100 rotates further, the extended end 132 of cam 130 no longer contacts pin base 123, thereby removing the radial force on pin base 123 and allowing spring 122 to expand to its original length and pin 120 to retract.

When retention area 110 is empty, that is, without a slider 50 therein, pin 120 should be retracted into carousel 100, preferably below retention base 112, so that little or no portion of pin 120 extends into retention area 110. When deposited from chute 150, slider 50 sits level on retention base 112 in retention area 110 with top wall 54 of slider housing 52 in contact with retention base 112 and second end 56 of slider housing 52 in contact with retention area back wall 114. Retaining pin 125 extends to hold slider 50 in area 110.

As shown in FIGS. 8 and 9, carousel 100 with slider 50 secured in retention area 110 rotates in a counter-clockwise direction so that first end 55 of slider housing 52 is the leading edge of slider 50. Packages 10' move from the right side of the figures to the left at a speed proportional to the rotation of carousel 100 and the spacing of retention areas 110 with sliders 50 therein. Of course, adjustments can be made to the apparatus of the present invention such that any motion of carousel 100, packages 10', or both will be acceptable to mount slider 50 onto closure mechanism 12. The speed of inchoate packages 10', or packages 10, should be set so that each slider 50 meets a notch 28 in a package 10'. Likewise, each notch 28 should meet with a slider 50. This is explained further below.

The method for mounting slider 50 onto closure mechanism 12 can be described in reference to FIGS. 8 and 9. Slider 50, positioned in retention area 110, is brought into contact with package 10' so that first end 55 of housing 52 intersects package 10' at notch 28 at an angle, for example, 20–60°, preferably at about 45°. FIG. 8 shows first end 55 of slider 50 partially mounted on closure mechanism 12 at notch 28. Pin 120 is partially extended. First end 55, in particular wedges 68, 69 (FIGS. 3 and 5) of housing 52, is forced onto closure profiles 30, 40 (FIGS. 2 and 7) of closure mechanism 12 by fully extended pin 120 in FIG. 9 so that flanges 39, 49 (FIG. 2) and first and second closure profiles 30, 40 distort from their original position (shown in FIGS. 2 and 7) so that first and second hooking constructions 76, 78 (FIGS. 4, 6 and 7) pass over closure profiles 30, 40. To extend pin 120, the enlarged end 132 of cam 130 contacts pin base 123 simultaneously or soon after first end 55 intersects notch 28. Pin 120 is pushed radially outward by cam 130 so that contact end 124 extends into retaining area 110 and ejects slider 50 from retaining area 110. Once the first and second hooking constructions 76, 78 have snapped over and engaged shoulders 38, 48 of the closure profiles 30, 40, the entire housing 52 easily follows aided by the push from pin 120.

During the mounting process, retaining pin 125 should be retracted to allow slider 50 to be removed from retaining area 110. Pin 125 may retract immediately before, or during the mounting process.

To achieve proper placement of slider 50 onto closure mechanism 12, package 10' should be securely held during the mounting process to minimize any displacement of package 10' in respect to carousel 100. Guides 102, 104 or other clamping device can be used to stabilize the web of packages 10' during the mounting of slider 50.

Package 10 with slider 50 mounted thereon is moved away from carousel 100 and another package 10 is positioned for mounting of a slider 50 thereon. Slider guide chute 150 deposits another slider 50 into an aligned retaining area 110.

It should be noted that movement of the package web may be continuous or may be indexed. That is, package 10 may be stationary during the mounting of slider 50 and is moved so that a next package 10 can be positioned for mounting of a slider 50. Similarly, carousel 100 may be stationary during the mounting process and indexed to the next retention area 110 with slider 50 when the next slider 50 is to be mounted, or carousel 100 may continuously rotate. Preferably, both the package web and carousel 100 move continuously during the mounting process.

Figure 10:
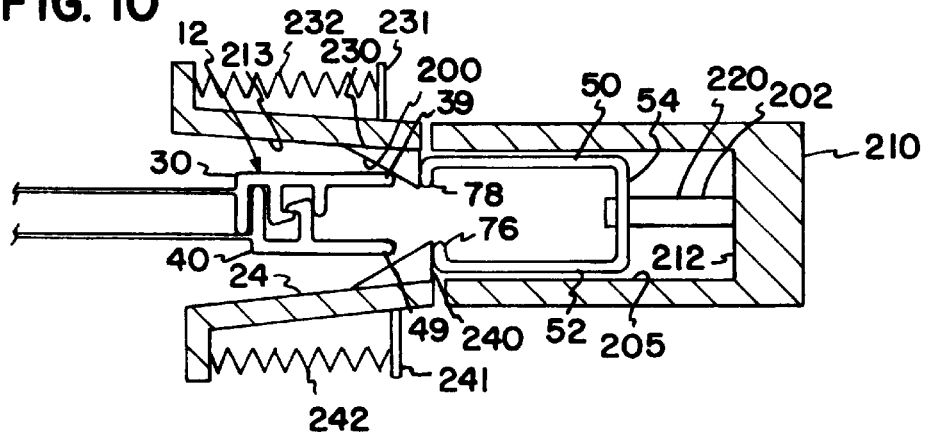
FIG. 10 is a cross-sectional schematic illustration of a second method of applying a slider device to a recloseable package, according to an example embodiment of the present invention.
Figure 11:
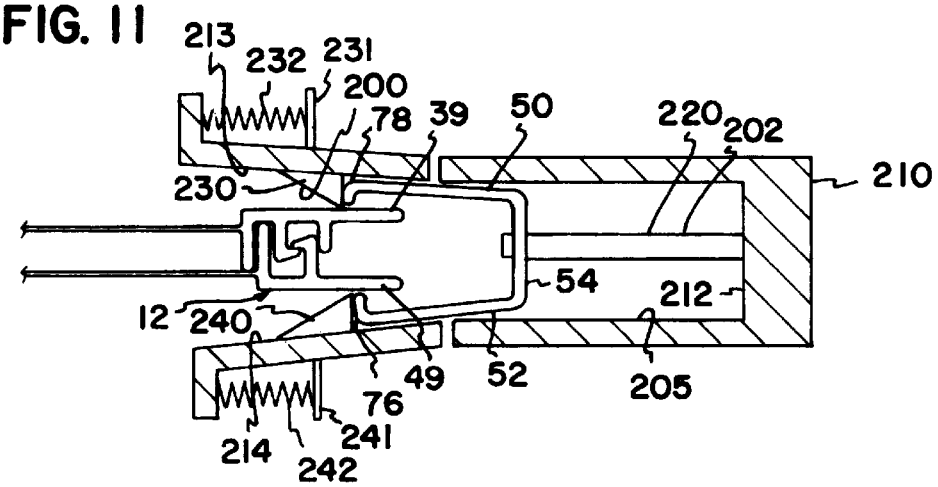
FIG. 11 is a cross-sectional schematic illustration of a further step in the second method of FIG. 10 of applying a slider device to a recloseable package, according to an example embodiment of the present invention.
Figure 12:
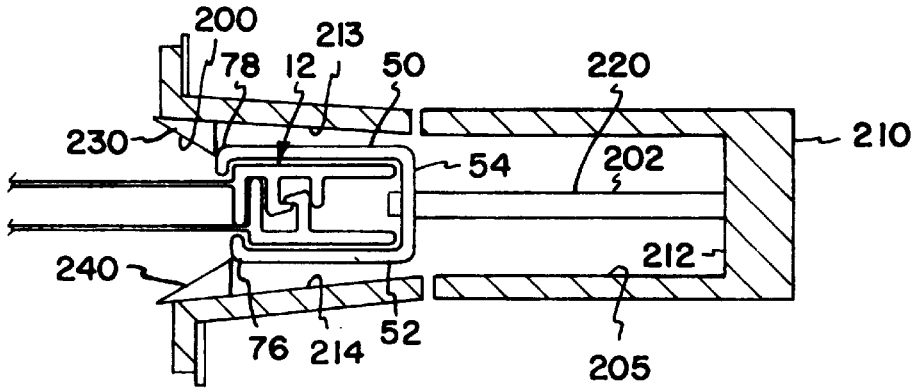
FIG. 12 is a cross-sectional schematic illustration of yet a further step in the second method of FIG. 10 of applying a slider device to a recloseable package, according to an example embodiment of the present invention.

A second embodiment of a process for mounting slider 50 onto closure mechanism 12 is shown in FIGS. 10 through 12. FIGS. 10 through 12 show slider 50 being mounted onto closure mechanism 12 having first and second closure profiles 30, 40. In accordance with this embodiment, first and second upper flanges 39, 40 of first and second closure profiles 30, 40, respectively, are distorted from their original position (shown in FIGS. 2 and 7) to facilitate the mounting of slider 50 onto closure mechanism 12. By "distorted", it is meant that the flanges experience elastic deformation; that is, the shape of each of at least one of the flanges is deformed by some force, and when the force is removed, the flange returns to its original shape before being deformed. First and second hooking constructions 76, 78 of slider 50 may also be distorted during the process of mounting slider 50 onto closure mechanism 12.

Before mounting slider 50 onto the closure mechanism 12, slider 50 is positioned within a support 205 that aligns slider 50 with the closure mechanism 12 on which slider 50 will be mounted. The support 205 can be configured for manual placement of slider 50 therein, or slider 50 may be deposited into the support 205 by any automated mechanism. Preferably, a continuous supply of sliders 50 is fed to the support 205. In the embodiment illustrated in FIGS. 10 through 12, support 205 includes a slider retainer 210.

FIG. 10 shows slider 50 held in the slider retainer 210 in a manner so that top wall 54 of slider housing 52, and preferably all of housing 52, is positioned within retainer 210. Retainer 210 includes an ejection system 202 for urging slider 50 out from retainer 210 and onto closure mechanism 12. As illustrated in FIGS. 10 through 12, a pin 220, which extends into the area occupied by slider 50, can be used as an ejection system 202 to push slider 50 from retainer 210. In FIGS. 10 through 12, pin 220 is extendible from, and retractable to, backwall 212 of retainer 210. Pin 220 may be configured to seat within open aperture 58 (FIG. 3) of housing 52 to increase stabilization of slider 50 on pin 220. Slider 50 is positioned so that first and second hooking constructions 76, 78 extend outward from retainer 210 and pin 220 toward closure mechanism 12.

Recloseable closure mechanism 12, comprising first and second closure profiles 30, 40, is positioned so that first and second upper flanges 39, 49 extend toward slider 50 in retainer 210. Similar to the first embodiment described above, package 10 may exist as an individual package 10 or as inchoate package 10' during the process of attaching slider 50. Additionally, slider 50 can be mounted onto closure mechanism 12 without closure mechanism 12 being attached to first and second panel sections 13, 14.

To achieve proper placement of slider 50 onto closure mechanism 12, closure mechanism 12 is preferably securely held in some manner during the mounting process so that any displacement of closure mechanism 12 in respect to retainer 210 is minimized. Adjacent to first and second closure profiles 30, 40 are closure guide walls 213, 214, respectively, which provide proper placement for closure profiles 30, 40.

Guide walls 213, 214 also provide a support surface for the mounting of a flange distorting system 200 used for the process of mounting slider 50 onto closure mechanism 12. Moveably positioned on closure guide walls 213, 214 is the flange distorting system 200, which distorts and deforms at least the distal end of closure mechanism 12, particularly upper flanges 39, 49, and allows slider 50 to be mounted onto closure mechanism 12. The flange distorting system preferably includes a mechanism that allows the flange distorting system to be used repeatedly, rather than a single use.

As illustrated in FIGS. 10 through 12, moveably positioned on guide walls 213, 214 are triangular first and second guides 230, 240 with their sloped surfaces directly adjacent upper flanges 39, 49, respectively, that are used to distort flanges 39, 49. Each of first and second guides 230, 240, respectively, is communicably attached to first and second guide levers 231, 241 and first and second springs 232, 242, respectively, which allow first and second guides to be used repeatedly. First and second guides 230, 240 and first and second guide levers 231, 241 are moveable along the length of closure guide walls 213, 214, for example through a slot extending through guide walls 213, 214. With springs 232, 242 in their fully extended position, first and second guides 230, 240 are positioned between closure profiles 30, 40 and first and second hooking constructions 76, 78, as shown in FIG. 10. In particular, first guide 230 is between first closure profile 30 and hooking construction 78, and second guide 240 is between second closure profile 40 and hooking construction 76.

According to the process of the present embodiment, to mount slider 50 onto first and second closure profiles 30, 40 of closure mechanism 12, slider 50 is positioned in slider retainer 210, and closure mechanism 12 is aligned between closure guide walls 213, 214 with first and second guides 230, 240 in an original position with springs 232, 242 extended. Pin 220 extends from retainer backwall 212, contacting top wall 54 of slider housing 52 and pushing slider 50 out of retainer 210 until first and second hooking constructions 76, 78 contact and abut first and second guides 230, 240, respectively. As pin 210 continues to push slider 50 away from backwall 212 and against guides 230, 240, guides 230, 240 are pushed by hooking constructions 76, 78 so that the sidewalls of guides 230, 240, make contact with upper flanges 39, 49.

FIG. 11 illustrates how upper flanges 39, 49 are distorted by guides 230, 240 as guides 230, 240 are pushed by slider 50. Flanges 39, 40 are distorted or bent inward toward each other by the sloped inner walls of guides 230, 240, thereby decreasing the overall width of closure mechanism 12 at that distal end. With the width of flanges 39, 49 decreased, first and second hooking constructions 76, 78 of slider 50 can be pushed over flanges 39, 49 and closure mechanism 12 until slider 50 is snapped over shoulders 38, 48, as is finally shown in FIG. 12.

Hooking constructions 76, 78 and other portions of slider housing 52 may be slightly distorted outward during the mounting process by the force of pushing slider 50 over closure mechanism 12. Closure guide walls 213, 214 can be sloped to allow room for expansion of slider housing 52 as it is pushed onto closure mechanism 12.

Once closure mechanism 12 with the slider 50 mounted thereon is removed from between closure guide walls 213, 214, guides 230, 240 are returned to their original position by the return of springs 232, 242 to their extended position. Likewise, pin 220 is retracted towards backwall 212 so that slider retainer 210 is ready to accept another slider 50 for mounting onto another closure mechanism 12.

Closure mechanism 12, as attached to package 10, inchoate package 10', or individually, can be manually placed within closure guide walls 213, 214 or may be automatically placed and removed. Package 10 and closure mechanism 12 may be limited to individual bags placed within closure guide walls 213, 214 or may be an extended web of inchoate packages 10', such as described in the first process embodiment, above.

Figure 13:
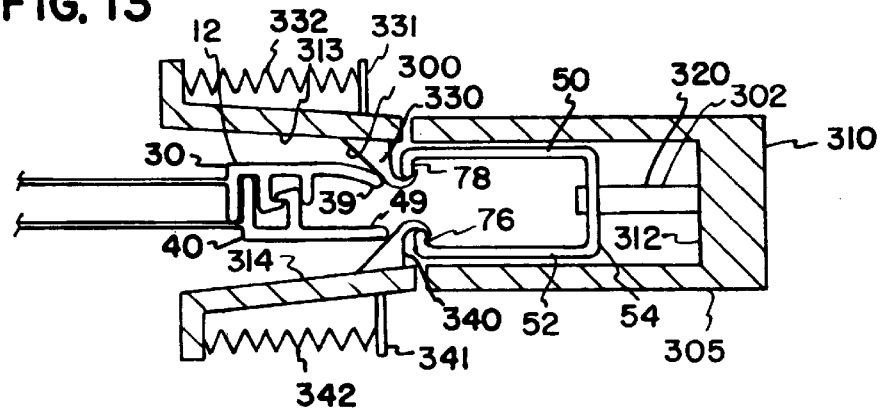
FIG. 13 is a cross-sectional schematic illustration of a third method of applying a slider device to a recloseable package, according to an example embodiment of the present invention.
Figure 14:
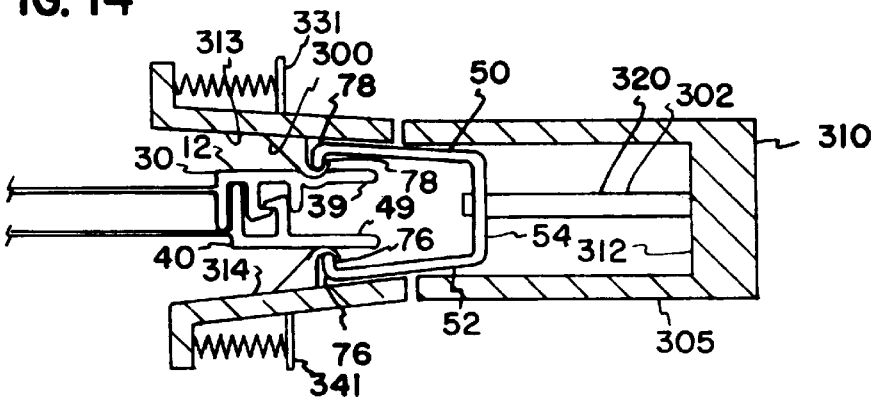
FIG. 14 is a cross-sectional schematic illustration of a further step in the third method of FIG. 13 of applying a slider device to a recloseable package, according to an example embodiment of the present invention.
Figure 15:
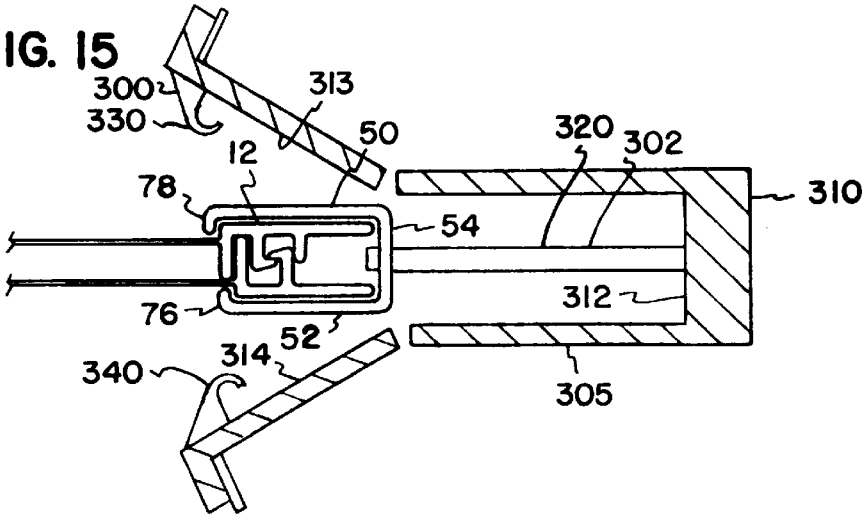
FIG. 15 is a cross-sectional schematic illustration of yet a further step in the third method of FIG. 13 of applying a slider device to a recloseable package, according to an example embodiment of the present invention.

A third embodiment of a process for mounting slider 50 onto closure mechanism 12 is shown in FIGS. 13 through 15. FIGS. 13 through 15 show slider 50 being mounted on a closure mechanism 12 having first and second closure profiles 30, 40. In accordance with this embodiment, first and second hooking constructions 76, 78 of slider 50 are distorted from their original position to facilitate the mounting of slider 50 onto closure mechanism 12. In this embodiment, the hooking construction 76, 78 are elastically deformed. First and second upper flanges 39, 49 of first and second closure profiles 30, 40, respectively, may also be distorted during the process of mounting slider 50 onto closure mechanism 12.

Before mounting slider 50 onto closure mechanism 12, slider 50 is positioned within a support 305 that aligns slider 50 with the closure mechanism 12 on which slider 50 will be mounted. The support 305 can be configured for manual placement of slider 50 therein, or slider 50 may be deposited onto support 305 by any automated mechanism. Preferably, a continuous supply of sliders 50 is fed to the support 305. In the particular embodiment illustrated in FIGS. 13 through 15, support 305 includes a slider retainer 310.

FIG. 13 shows a slider 50 held in slider retainer 310 in a manner so that top wall 54 of slider housing 52, and preferably all of housing 52, is positioned within retainer 310. Retainer 310 includes an ejection system 302 for urging slider 50 out from retainer 310 onto closure mechanism 12. As illustrated in FIGS. 13 through 15, a pin 320, which extends into the area occupied by slider 50, can be used as ejection system 302 to push slider 50 from retainer 310. In FIGS. 13 though 15, pin 320 is extendible from, and retractable to, backwall 312 of retainer 310. Pin 320 may be configured to seat within or engage with open aperture 58 (FIG. 3) of housing 52 to increase stabilization of slider 50 on pin 320. Slider 50 is positioned so that first and second hooking constructions 76, 78 extend outward from retainer 310 and pin 320 toward closure mechanism 12.

Recloseable closure mechanism 12, comprising first and second closure profiles 30, 40, is positioned so that first and second upper flanges 39, 49 extend toward slider 50 in retainer 310. Similar to the first and second embodiments described above, package 10 may exist as an individual package 10 or as an inchoate package 10' during the process of mounting slider 50. Additionally, slider 50 can be mounted onto closure mechanism 12 without closure mechanism being attached to first and second panel sections 13, 14.

To achieve proper placement of slider 50 onto closure mechanism 12, closure mechanism 12 is preferably securely held in some manner during the mounting process so that any displacement of closure mechanism 12 in respect to retainer 310 is minimized. Adjacent first and second closure profiles 30, 40 are closure guide walls 313, 314, respectively, which provide for proper placement for closure profiles 30, 40.

Closure guide walls 313, 314 also provide a support surface for the mounting of a hook distorting system 300 used for the process of mounting slider 50 onto closure mechanism 12. Moveably positioned on closure guide walls 313, 314 is the hook distorting system 300, which distorts and deforms first and second hooking constructions 76, 78 of slider housing 52, and allows slider 50 to be mounted onto closure mechanism. The hook distorting system 300 preferably includes a mechanism that allows the hook distorting system to be used repeatedly, rather than a single use.

As illustrated in FIGS. 13 through 15, moveably positioned on guide walls 313, 314 are first and second lifts 330, 340 which have sloped surfaces and a hooked end, used for distorting first and second hooking constructions 76, 78. Each of first and second lifts 330, 340, respectively, is communicably attached to first and second guide levers 331, 341 and first and second springs 332, 342, respectively, which allow first and second lifts to be used repeatedly. By "communicably attached", it is meant that lift 330, 340 and levers 331, 332 are physically connected and that movement of lifts 330, 340 produces likewise movement of levers 331, 341. First and second lifts 330, 340 and first and second guide levers 331, 341 are moveable along the length of closure guide walls 313, 314, for example through a slot extending through guide walls 313, 314. With springs 332, 342 in their fully extended position, first and second lifts 330, 340 are positioned between closure profiles 30, 40, and first and second hooking constructions 76, 78 as shown in FIG. 13.

According to the process of the present embodiment, to mount slider 50 onto first and second closure profiles 30, 40 of closure mechanism 12, closure mechanism 12 is aligned between closure guide walls 313, 314 with first and second lifts 330, 340 in an original position with springs 332, 342 extended. Pin 320 extends retainer backwall 312, contacting top wall 54 of slider housing 52 and pushing slider 50 out of retainer 310 until first and second hooking constructions 76, 78 contact and abut first and second lifts 330, 340, respectively. Each lift 330, 340 is shown having a hooked end 335, 345 that is insertable between hooking constructions 76, 78, respectively, and preferably catches hooking constructions 76, 78. As pin 310 continues to push slider 50 away from backwall 312 and against lifts 330, 340, lifts 330, 340 are pushed back along walls 313, 314 so that hooking constructions 76,78 are spread and optionally, lifts 330, 340 make contact with upper flanges 39, 49.

FIG. 14 shows how first and second hooking constructions 76, 78 are distorted by lifts 330, 340 as lifts 330, 340 are pushed along closure guide walls 313, 314 by slider 50. First and second hooking constructions 76, 78 are distorted or bent outward away from each other, thereby increasing the overall width of slider housing 52 at that point. With the width of housing 52 increased, slider 50 can be pushed over closure mechanism 12 until the slider 50 is snapped over shoulders 38, 48, as shown in FIG. 15. First and second closure profiles, in particular upper flanges 39, 49, and other portions of closure mechanism 12 may be slightly distorted inward by the force of pushing slider 50 over closure mechanism 12.

Once closure mechanism 12 with the slider 50 mounted thereon is removed from between closure guide walls 313, 314, lifts 330, 340 are returned to their original position by the return of springs 332, 342 to their extended position. Likewise, pin 320 is retracted toward backwall 312 so that slider retainer 310 is ready to accept another slider 50 for mounting onto another closure mechanism 12.

Closure mechanism 12, as attached to package 10, inchoate package 10'. Or individually, can be manually placed within closure guide lifts 330, 340 or may be automatically placed and removed. Package 10 and closure mechanism 12 may be limited to individual bags placed within closure guide lifts 313, 314 or may be an extended web or inchoate package 10" such as described in the first and second process embodiments, above.

The above specification and examples are believed to provide a complete description of the manufacture and use of particular embodiments of the invention. Many embodiments of the invention can be made without departing from the spirit and scope of the invention.

What is claimed is:

1. A method of mounting a slider device on a recloseable closure arrangement for a recloseable package, comprising:

(a) providing a recloseable closure arrangement;

(b) providing a slider device having a first end and a second opposite end, the slider device for opening and closing the closure arrangement; and (c) mounting the slider device onto the closure arrangement by:

(i) moving the slider device at an angle other than perpendicular relative to the closure arrangement;

(ii) intersecting the first end of the slider device with the closure arrangement;

(iii) snapping the first end of the slider device over the closure arrangement; and then (iv) snapping the second end of the slider device over the closure arrangement.

2. The method according to claim 1, wherein the step of intersecting the first end of the slider device with the closure arrangement comprises intersecting at an angle of about 45°.

3. The method according to claim 1, wherein the step of snapping the second end comprises ejecting the slider device over the closure arrangement.

4. The method according to claim 1, wherein the step of snapping the first end comprises snapping the first end so that the first end snaps over a shoulder of the closure arrangement.

5. The method according to claim 4, wherein the step of snapping the first end comprises snapping the first end so that the first end snaps over two shoulders of the closure arrangement.

6. The method according to claim 1, wherein the step of snapping the second end comprises snapping the second end so that the second end snaps over a shoulder of the closure arrangement.

7. The method according to claim 6, wherein the step of snapping the second end comprises snapping the second end so that the second end snaps over two shoulders of the closure arrangement.

8. The method according to claim 1, wherein the step of moving the slider device comprises using a rotating carousel to move the slider device.

9. The method according to claim 8, wherein the step of using a rotating carousel includes using a rotating carousel having an ejection system to push the slider.

10. The method according to claim 1, wherein the step of providing the slider device comprises providing a slider device having legs, wherein the legs can be spread to facilitate mounting of the slider.

* * * * *